US006098636A

United States Patent [19]

Curtiss et al.

[11] Patent Number: 6,098,636

[45] Date of Patent: Aug. 8, 2000

[54] HAIR CLIP

[76] Inventors: Mia Curtiss; Casey Curtiss, both of 323 W. 57th St., Hindale, Ill. 60521

[21] Appl. No.: 09/359,233

[22] Filed: Jul. 22, 1999

[51] Int. Cl.[7] ..... A45D 8/20

[52] U.S. Cl. ..... 132/277; 132/275

[58] Field of Search ..... 132/273, 275, 132/276, 277, 278, 279, 280, 200, 213, 214; D28/39, 40, 41, 42; 24/507, 521, 510, 509

[56] References Cited

U.S. PATENT DOCUMENTS

| | | | |
|---|---|---|---|
| 2,149,215 | 2/1939 | Fuscaldo et al. . | |
| 2,160,346 | 5/1939 | Valentine . | |
| 2,643,658 | 6/1953 | Koke | 132/276 |
| 3,111,129 | 11/1963 | Dekel | 132/277 |
| 3,111,130 | 11/1963 | Dekel | 132/277 |
| 3,141,218 | 7/1964 | Eckman . | |
| 3,362,052 | 1/1968 | Luchida | 132/277 |
| 3,603,321 | 9/1971 | Viltrakis | 132/277 |
| 3,968,806 | 7/1976 | Altemare . | |
| 3,983,887 | 10/1976 | Chan | 132/277 |
| 3,991,774 | 11/1976 | Wolfthal . | |
| 5,101,842 | 4/1992 | Ehmann . | |
| 5,758,672 | 6/1998 | Chou . | |

*Primary Examiner*—Gene Mancene
*Assistant Examiner*—Pedro Philogene
*Attorney, Agent, or Firm*—Mark E. Wiemett

[57] ABSTRACT

A hair clip for restraining at least two portions of hair during the cutting, coloring styling process includes a novel structure wherein two jaws independently operate by manipulation of two side-by-side finger grip structures. A first finger grip structure is communicative with a first jaw portion and a first surface of a common tongue portion. A second finger grip structure is communicative with a second jaw portion and a second surface of the common tongue portion. The second jaw portion is aligned with the first jaw portion and located thereunder. The first and second jaw portions pivotally connect the tongue portion and a pair of torsion springs urge the first and second jaw portions toward the tongue portion.

4 Claims, 6 Drawing Sheets

HAIR CLIP

FIELD OF THE INVENTION

The present invention relates generally to hair clips. More particularly, the present invention relates to a hair clip having two independently opening and closing jaws and a center tongue portion to grasp two separate bundles of hair when cutting, coloring or styling a person's hair.

BACKGROUND OF THE INVENTION

This invention is generally directed to a novel hair clip which secures a first lock by way of a first jaw and a center tongue and thereafter a second lock of hair by way of a second jaw and the center tongue to move unwanted hair from the section the stylist is cutting, coloring or styling.

Currently, several types of hair clips exist for grasping a lock hair. A substantial number of current hair clips include ornamental hair clips wherein such clip is used to secure a portion of hair. The ornamental hair clip remains in the hair coexisting with the hair to portray a fashioned coiffure. Other types of hair clips exist wherein such clips are utilized predominately in the coiffuring process. One example of such a hair clip includes one which fastens a portion of hair to a hair roller or curler. Generally, a hairdresser applies a cylindrical shaped curler to a person's hair by coiling a portion of hair around the periphery of the curler. Thereafter, to secure the curler, the hairdresser applies a clamping type hair clip thereupon the hair and curler to secure the curler. The hair clip and curler are removed and, if successful, the hair retains a curl shape.

The clamping type hair clip generally consists of a pair of jaws each of which has a handle formed integral therewith. Each jaw and its handle is formed from a metal strip or blank which tapers from its rear end towards its front end and intermediate its length each strip is provided with an integral hinging portion. A torsional spring is introduced at the hinge portion to keep the jaws together when the hair clip is untouched. The pair of jaws are opened when a user pinches or squeezes together the handles, at the rear end of the hair clip, to urge the pair of jaws apart. A substantial number of clips include a similar configuration and differ only as to the structure of the jaw portions and the torsional spring. Other like clips differ only as to spring type and include a v-shaped spring, ogee spring, or other like biasing element.

Yet another type of clip allows a user to coil a portion of hair around a center portion of the clip and thereafter clamp such hair by an attached clamping structure, eliminating the need of the hair curler. Once such hair clip is removed the restrained hair retains a curled shape.

SUMMARY OF THE INVENTION

Briefly, and in accordance with the foregoing, the invention discloses a hair clip comprising a first projecting jaw portion and a second projecting jaw portion substantially overlaying a tongue portion therebetween. The first projecting jaw portion is attached to a first finger grip structure having first and second grip portions. The second projecting jaw portion is attached to an offset portion which attaches a third grip portion. An offset portion attaching the tongue portion includes a fourth grip portion. The third and fourth grip portions comprise a second finger grip portion and is located adjacent to the first finger grip structure. The first projecting jaw is pivotally attached to a first surface of the tongue portion and the second projecting jaw is pivotally attached to a second surface of the tongue portion. First and second torsion springs having clips therethrough are placed at the pivotal attachments of the first and second projecting jaw portions to urge the same toward the tongue portion.

Generally, a stylist pinches the first finger grip structure of the hair clip to open the first jaw in receiving and retaining a first lock of hair, wherein such first lock of hair is proximate to the person's scalp. Second, the stylist pinches the second finger grip structure of the hair clip to open the second jaw in receiving and retaining a second lock of hair wherein such second lock of hair is proximate to the outermost extents of the person's hair ends. Generally, a loop of hair is formed by the aforementioned operation and the stylist may access the underneath layers of hair without being inhibited by outermost ends and outermost layers of hair.

Accordingly, it is a general object of the present invention to provide an apparatus for independently and contemporaneously securing two separate portions of hair during the cutting, coloring or styling process.

Another general object of the present invention is to provide a single hair clip having the hair restraining capacity of two standard hair clips.

Another general object of the present invention is to provide a single hair clip in a myriad of situations which normally require two hair clips.

Another general object of the present invention is to provide a hair clip having two adjacent finger grip portions for quick and effective use by a stylist.

Another general object of the present invention is to provide a hair clip, having two restraining portions independently operative, however, such clip preserving a traditional hair clip manifestation.

Another general object of the present invention is to provide a hair clip, with dual hair portion restraint, of a robust nature required by stylists in settings mandating multiple abusive usages over long periods of time.

BRIEF DESCRIPTION OF THE DRAWINGS

The foregoing and other additional objects of the present invention will be readily appreciated by those skilled in the art upon gaining an understanding of the invention as described in the following detailed description and shown in the accompanying drawings in which.

DETAILED DESCRIPTION OF THE INVENTION

Figure 1:
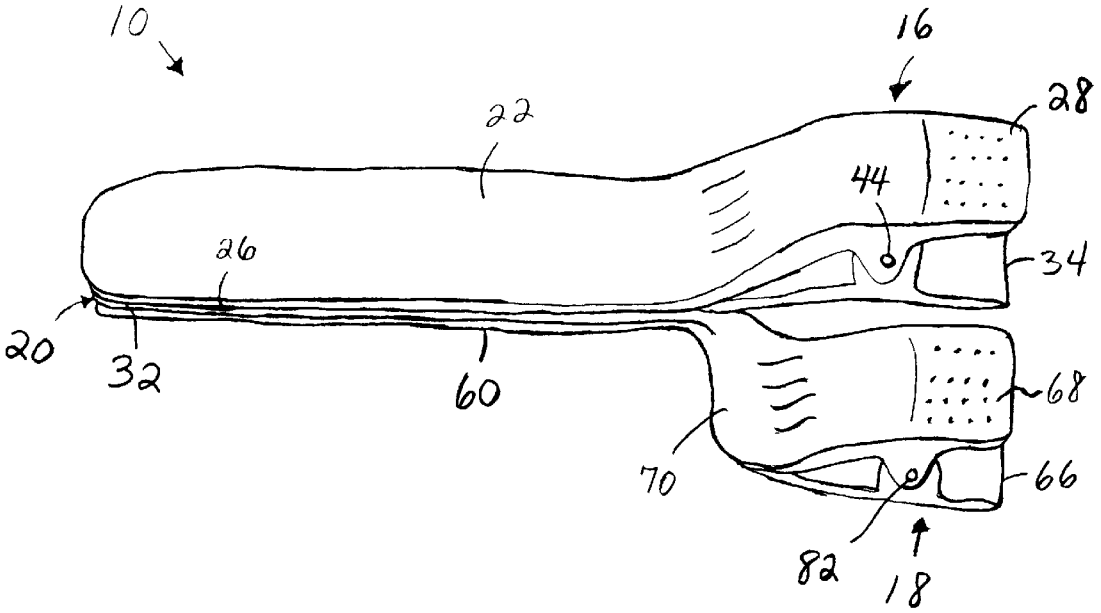
FIG. 1 is a side elevational view of the present invention hair clip.
Figure 2:
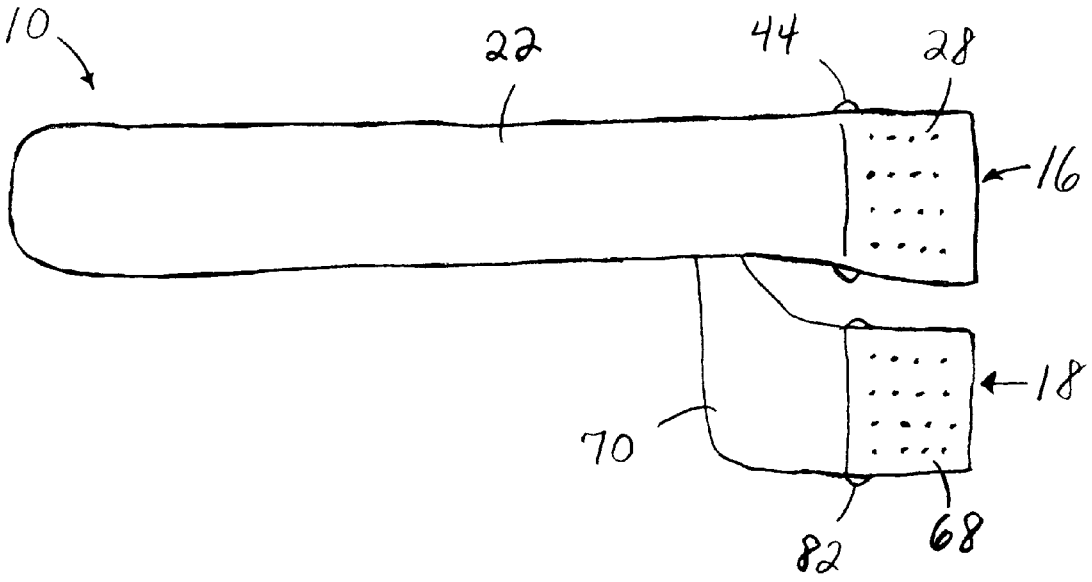
FIG. 2 is a top view of the present invention hair clip.
Figure 3:
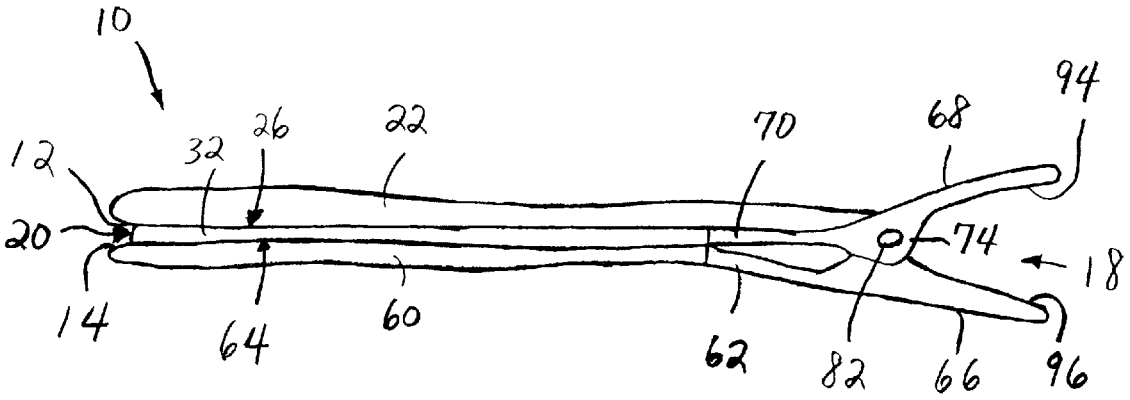
FIG. 3 is a side view of the present invention hair clip.
Figure 4:
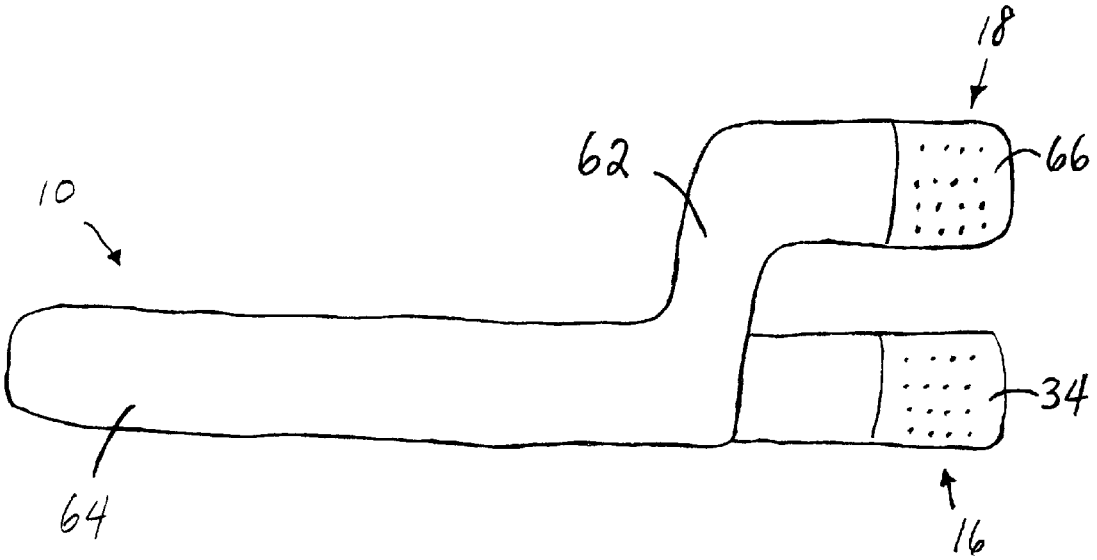
FIG. 4 is a bottom view of the present invention hair clip.
Figure 5:
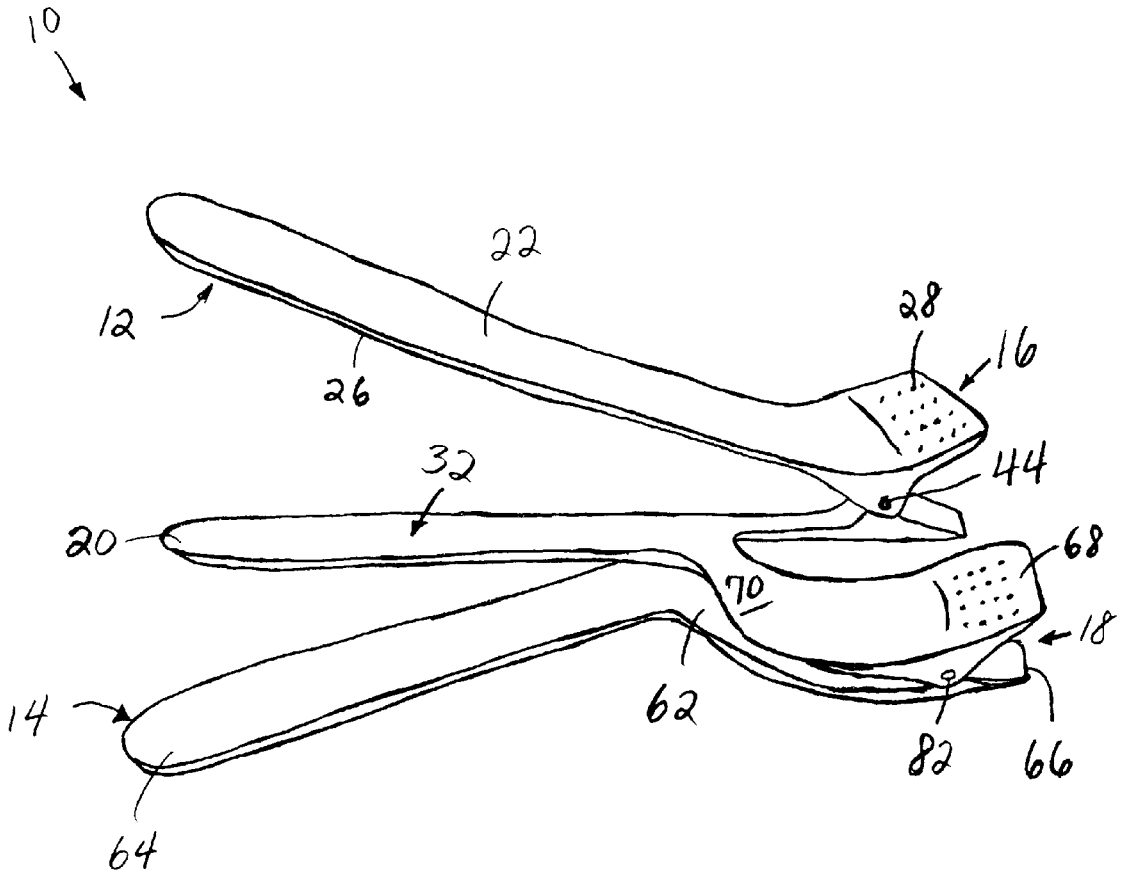
FIG. 5 is a side elevational view disclosing a first jaw and a second jaw in the open configuration of the present invention hair clip.
Figure 6:
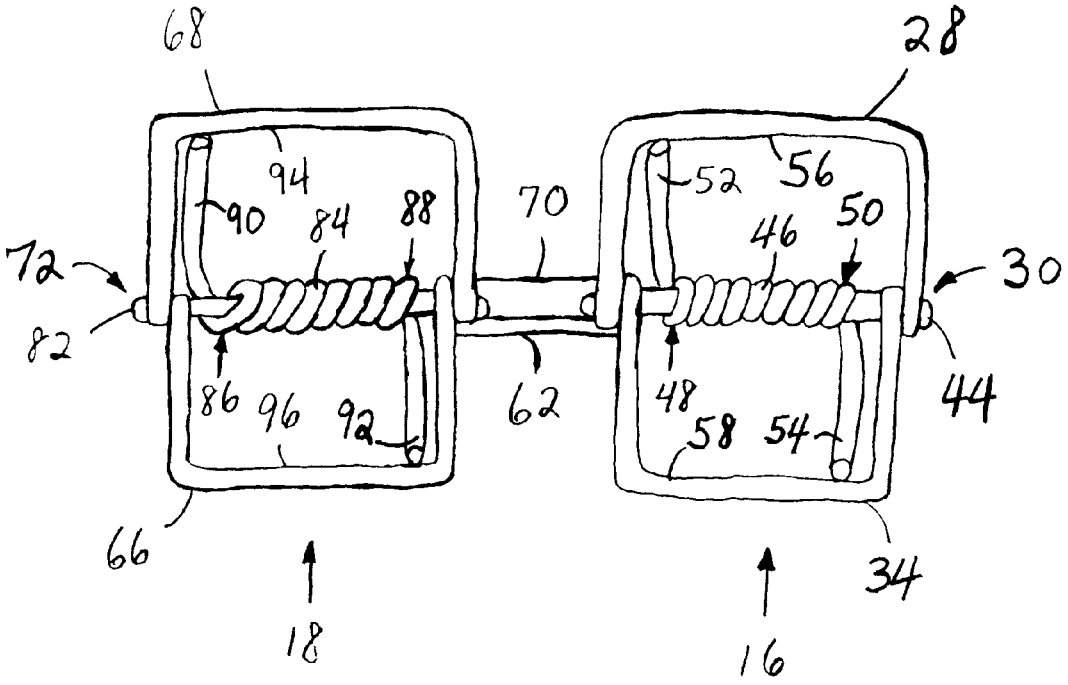
FIG. 6 is a rear view disclosing the return means of the present invention hair clip.

While the invention may be susceptible to embodiments in different forms, there is shown in the drawings, and herein will be described in detail, specific embodiments with the understanding that the present disclosure is to be considered an exemplification of the principles of the invention, and is not intended to limit the invention to that as illustrated and described herein.

As shown in FIG. 1, a hair clip 10, constructed in accordance with the present invention, includes a first jaw 12, a second jaw 14, a first finger grip structure 16 and a second finger grip structure 18. The first jaw 12 being independently operative, by user manipulation of the first finger grip structure 16. Similarly, the second jaw 14 is independently operative by user manipulation of the second finger grip structure 18. The first jaw 12 and the second jaw 14 share an elongated center member 20.

The first jaw 12 includes a first elongated member 22, the elongated center member 20 and a first jaw return means 24 for urging the first elongated member 22 toward the elongated center member 20. Generally, the first elongated member 22 is formed from a piece of aluminum sheet through a stamping process, however, the first elongated member 22 of the hair clip 10 may be comprised of any one of a host of metallic materials of construction and formed from any process yielding a similar result as a stamping process. The first elongated member 22 includes a first jaw portion 26 configured to be generally elongate and curved in shape and of a suitable length to restrain an ample portion of hair (not shown). Attached thereto and extending substantially opposite therefrom the first jaw portion 26 is a first grip portion 28 of the first elongated member 22. The first grip portion 28 extends outwardly with respect to the first jaw portion 26 so that a user may quickly apply a finger tip to the first grip portion 28.

The first elongated member 22 pivotally attaches the elongated center member 20 at a first hinge 30. The first jaw portion 26 of the first elongated member 22 pivots about the first hinge 30 and is urged away from a tongue portion 32 of the elongated center member 20 when a user applies a contemporaneous inward force to the first grip portion 28 of the first elongated member 22 and a second grip portion 34 of the elongated center member 20. The first grip portion 28 and the second grip portion 34 comprise the first finger grip structure 16. Generally, the hair clip 10, when left untouched by a user, is in a closed position (see FIG. 1) with the first jaw portion 26 of the first elongated member 22 substantially overlaying the tongue portion 32 of the elongated center member 20. The first jaw return means 24 urge the first jaw portion 26 of the first elongated member 22 to overlay and be substantially parallel thereto the tongue portion 32 of the elongated center member 20 when a user releases the first grip portion 28 and the second grip portion 34.

The first hinge 20 includes a first pair of ears 36 extending opposite the first grip portion 28 located proximate to the intersection of the first jaw portion 26 and the first grip portion 28 of the first elongated member 22. A second pair of ears 38 extending outwardly therefrom the intersection of the second grip portion 34 and the tongue portion 32 pivotally communicate with the first pair of ears 36 of the first elongated member 22. The first pair of ears 36 include a first pair of holes 40 therethrough. Similarly, the second pair of ears 38 include a second pair of holes 42. The first pair of holes 40 of the first pair of ears 36 align therewith the second pair of holes 42 of the second pair of ears 38. The aligned first pair of holes 40 and the second pair of holes 42 receive a first clip 44 therein to rotatably restrain the first elongated member 22 within the elongated center member 20.

The first jaw return means 24 for urging both the first jaw portion 26 toward the tongue portion 32 includes a torsion spring 46. The torsion spring 46 includes a first end 48 and a second end 50. The first end 48 of the torsion spring 46 has a first leg 52 and the second end 50 of the torsion spring 46 has a second leg 54 attached thereto. The first clip 44 fits therethrough the torsion spring 46 with the first leg 52 of the torsion spring 46 in contact with and secured thereagainst an inner surface 56 of the first grip portion 28 of the first elongated member 22 and the second leg 54 of the torsion spring 46 is in contact with and secured thereagainst an inner surface 58 of the second grip portion 34 of the elongated center member 20.

The second jaw 14 of the hair clip 10 includes a second elongated member 60, the elongated center member 20 and a second jaw return means 61. The second elongated member 60 is generally formed from a single sheet-metal stamping. The second jaw portion 14 is configured to be generally elongate and curved in shape and of a suitable length to restrain an ample portion of hair (not shown). The second elongate member 60 includes a generally S-shaped offset portion 62, a second jaw portion 64 and a third grip portion 66. The offset portion 62 connects the second jaw portion 64 with the third grip portion 66. Similar to the second grip portion 34, the third grip portion 66 extends outwardly with respect to the second jaw portion 64 so that a user may quickly apply a finger tip to the third grip portion 66.

A fourth grip portion 68, attaching to a generally S-shaped offset portion 70 of the elongated center member 20, is positioned parallel and adjacent the first grip portion 28. The third grip portion 66 and the fourth grip portion 68 are substantially adjacent thereto the second grip portion 34 and the first grip portion 28, respectively. The second elongated member 60 pivotally attaches the elongated center member 20 at a second hinge 72.

The offset portion 70 of the second elongated member 60 and the offset portion 62 of the elongated center member 20, the third grip portion 66, and the fourth grip portion 68 comprise the second finger grip structure 18 which is side-by-side the first finger grip structure 16, however, the second jaw portion 64 is directly thereunder the first jaw portion 26, with the tongue portion 32 therebetween. The second jaw portion 64 and the offset portion 62 of the second elongated member 60 substantially overlays the tongue portion 32 and the offset portion 70 of the elongated center member 20, respectively, when a user releases the second finger grip structure 18.

The second jaw portion 64 of the second elongated member 60 pivots about the second hinge 72 and is urged away from the tongue portion 32 of the elongated center member 20 when a user applies a contemporaneous inward force to the third grip portion 66 of the second elongated center member 20. Generally, the hair clip 10, when left untouched by a user, is in the closed position (se FIG. 1) with both the first jaw portion 26 and the second jaw portion 64 substantially overlaying the tongue portion 32 of the elongated center member 20. The second jaw return means 61 urges the second jaw portion 64 of the second elongate member 60 to overlay and be substantially parallel thereto the tongue portion 32 of the elongated center member 20 when a user releases the third grip portion 66 and the fourth grip portion 68.

The second hinge 72 includes a first pair of ears 74 extending opposite the third grip portion 66 located proximate to the intersection of the second jaw portion 64 and the third grip portion 66 of the second elongated member 60. A second pair of ears 76 extending outwardly therefrom the intersection of the fourth grip portion 68 and the offset portion 70 of the elongated center member 20, pivotally communicate with the first pair of ears 74 of the second elongated member 60. The first pair of ears 74 include a first pair of holes 78 therethrough. Similarly, the second pair of ears 76 include a second pair of holes 80. The first pair of holes 78 of the first pair of ears 74 align therewith the second pair of holes 80 of the second pair of ears 76. The first pair of holes 78 and the second pair of holes 80 substantially align and receive a second clip 82 therein to rotatably restrain the second elongated member 60 within the elongated center member 20.

The second jaw return means 61 for urging the second jaw portion 64 toward the tongue portion 32 includes a torsion spring 84. The torsion spring 84 includes a first end 86 and a second end 88. The first end 86 of the torsion spring 84 has a first leg 90 and the second end 88 of the torsion spring 84 has a second leg 92 attached thereto. The second clip 82 fits therethrough the torsion spring 84 with the first leg 90 of the torsion spring 84 in contact with and secured thereagainst an inner surface 96 of the fourth grip portion 68 of the elongated center member 20 and the second leg 92 of the torsion spring 84 is in contact with and secured thereagainst an inner surface 96 of the third grip portion 66 of the second elongated member 60.

Generally, a stylist pinches the first finger grip structure 16 of the hair clip 10 to open the first jaw 12 in receiving and retaining a first lock of hair 98 (not shown), wherein such first lock of hair 98 is proximate to a person's scalp 100 (not shown). Second, the stylist pinches the second finger grip structure 18 of the hair clip 10 to open the second jaw 14 in receiving and retaining a second lock of hair 102 (not shown) wherein such second lock of hair 102 is proximate to outermost extents of the person's hair ends 104 (not shown). Generally, a loop of hair 106 (not shown) is formed by the aforementioned operation thereby providing for the stylist access to underneath layers of hair 108 (not shown). Thereafter, the stylist may cut, style or coiffure underneath layers of hair 108 without being inhibited by both consecutive outermost layers of hair 108 (not shown) and the outermost extents of hair ends 104.

I claim:

1. A hair clip comprising:

a. a first jaw portion, said first jaw portion having a first end and a second end extending therefrom;

b. a second jaw portion, said second jaw portion having a first end and a second end extending therefrom, said first jaw portion substantially aligning therewith said second jaw portion;

c. a tongue portion, said tongue portion having a first end and a second end extending therefrom, said tongue having a first surface and a second surface, said tongue portion disposed therebetween said first jaw portion and said second jaw portion, said first jaw portion substantially overlaying said first surface of said tongue portion and said second jaw portion substantially overlaying said second surface of said tongue portion;

d. first jaw attachment means for pivotally attaching said first end of said first projecting jaw to said first end of said first surface of said tongue portion;

e. second jaw attachment means for pivotally attaching said first end of said second jaw to said first end of said second surface of said tongue portion;

f. return means for urging said second end of said first jaw and said second end of said second jaw toward said second end of said tongue portion;

g. first jaw opening means for rotatably urging said second end of said first jaw away from said second end of said tongue portion;

h. second projecting jaw opening means for rotatably urging said second end of said second jaw away from said second end of said tongue portion.

2. The hair clip of claim 1, wherein first jaw attachment means comprises a first pair of ears integrally attached to said tongue portion, said first and second pair of ears having holes therethrough and aligning therewith, a first clip extending therethrough said holes.

3. The hair clip of claim 1, wherein said second jaw attachment means comprises a third pair of ears integrally attached to said second jaw and a fourth pair of ears integrally attached to said tongue portion, said third and fourth pair of ears having holes therethrough and aligning therewith, a second clip extending therethrough said holes.

4. A process of contemporaneously restraining at least two separate portions of hair within a hair clip wherein such hair clip comprises: a first jaw, a second jaw, said first jaw cojoined with said second jaw at a tongue portion, including the steps of:

a. removeably restraining a first portion of hair therebetween a first jaw portion and said tongue portion; and b. removeably restraining a second portion of hair therebetween a second jaw portion and said tongue portion to expose underlayers of hair.

* * * * *